United States Patent [19]

Lippert

[11] Patent Number: 4,938,414

[45] Date of Patent: Jul. 3, 1990

[54] POSTCARD TYPE MAILING PIECE WITH REMOVABLE MESSAGE LABELS

[76] Inventor: Ludwig Lippert, 8422 Blakiston La., Alexandria, Va. 22308

[21] Appl. No.: 346,732

[22] Filed: May 3, 1989

[51] Int. Cl.[5] ..... B65D 27/00

[52] U.S. Cl. ..... 229/92.8; 40/299; 206/813; 428/42

[58] Field of Search ..... 229/92, 92.8; 40/158.1, 40/299; 428/42; 206/813

[56] References Cited

U.S. PATENT DOCUMENTS

| | | | |
|---|---|---|---|
| 878,556 | 2/1908 | Palm, Jr. | 229/92.8 |
| 2,213,666 | 9/1940 | Burke | 206/813 X |
| 2,363,472 | 11/1944 | Ritter | 229/92.8 |
| 2,805,816 | 9/1957 | Morgan . | |
| 3,356,286 | 12/1967 | Greason . | |
| 3,494,056 | 2/1970 | Elzer | 40/299 |
| 3,655,121 | 4/1972 | Ward . | |
| 3,986,283 | 10/1976 | Pelaez | 229/92.8 X |
| 4,070,778 | 1/1978 | Mahler et al. | 229/92.8 X |
| 4,079,881 | 3/1978 | Sabb . | |
| 4,324,058 | 4/1982 | Sherwick et al. | 40/310 |
| 4,379,573 | 4/1983 | Lomeli et al. | 428/42 |
| 4,572,855 | 2/1986 | Kalus et al. | 40/638 X |
| 4,662,093 | 5/1987 | Shuttles et al. . | |
| 4,708,285 | 11/1987 | Segall . | |
| 4,807,807 | 2/1989 | Glick | 229/92.8 |
| 4,809,905 | 3/1989 | Goodman | 428/42 X |
| 4,821,439 | 4/1989 | Wilck | 40/299 X |
| 4,895,747 | 1/1990 | Birkholz et al. | 428/42 |

FOREIGN PATENT DOCUMENTS

| | | | |
|---|---|---|---|
| 299598 | 1/1989 | European Pat. Off. | 40/299 |

*Primary Examiner*—Stephen Marcus
*Assistant Examiner*—Jes F. Pascua
*Attorney, Agent, or Firm*—Foley & Lardner, Schwartz, Jeffery, Schwaab, Mack, Blumenthal & Evans

[57] ABSTRACT

A postcard-type mailing piece with removable messages constructed of a paper sheet of 40 to 60 lb. paper stock and message labels of 100 lb. paper stock using a silicone release coating adhesive to releasably bond the message labels to the paper sheet. The mailing piece is capable of receiving a multi-color printing without smudging or bleeding.

4 Claims, 1 Drawing Sheet

POSTCARD TYPE MAILING PIECE WITH REMOVABLE MESSAGE LABELS

BACKGROUND OF THE INVENTION

This invention relates to a new and improved postcard-type mailing piece. More particularly, the invention relates to a mailing piece which may be of postcard size, with one or more removable message labels adhesively bonded to one surface thereof. Still more particularly, the invention is directed to a mailing piece having at least one removable message label with a coating of an adhesive such as to enable the message label to readhere to a variety of surfaces following removal from the mailing piece.

Mailing pieces have heretofore been designed and constructed for mailing to which have been applied advertising, commercial or other messages or photographs. All such prior articles, however, suffer from one or more disadvantages especially when it is contemplated to apply a multi-color printing to one or both surfaces of the mailing piece. In some cases, adhesives used were either inadequate to resist postal handling, in which case the message label may be lost, or if strong enough to bond to the paper mailing piece, did not satisfactorily adhere to surfaces of other materials. The adhesive used to bond the message label to the paper stock of the mailing piece must be strong enough to withstand handling during postal or other distribution yet have sufficient bonding strength and releasability such that the message label may be removed from the mailing piece and reapplied to a variety of surfaces which may be made of paper, cloth, glass, metal, wood, plastic etc. The surface of the paper stock for the mailing piece must permit adhesion by the adhesively bonded message label but must also be capable of accepting and retaining marking by inks from writing implements such as ballpoint pens, felt tip pens, pencils, typewriter ribbons, as well as multi-color printing, without smudging and bleeding. Similarly, the paper stock used for the message label must be capable of receiving multi-color printing, also without smudging and bleeding.

Various articles have been proposed for mailing pieces, some of which include peelable message labels on one side thereof. For ordinary ink-written messages, bleeding of the ink through the paper stock used for postcard manufacture is not a problem. It is sufficient to merely employ paper stock of sufficient thickness to resist penetration of the ink. However, for mailing pieces with removable message labels that are designed to have multi-color printing, e.g. four or eight color printing, applied to one or both sides thereof, it is necessary to carefully select construction materials including paper stock and adhesives for the mailing piece and the removable message label.

U.S. Pat. No. 4,079,881 to Sabb describes a postcard for attaching and mailing pictures comprising a single, non-laminated, piece of paper stock. An address and message may be written on one surface and the other surface may be covered with an adhesive for holding a photograph in place during mailing. The photograph is removable by peeling from the body of the card.

U.S. Pat. No. 2,805,816 to Morgan describes a composite business mailing card having one surface which may be addressed or inscribed and postage applied thereto; and another surface having a coating affixed to the entire face which is resistent to permanent adhesion of pressure sensitive adhesive materials. Information labels having a pressure sensitive adhesive coating are applied to the adhesive resistant coating surface of the card. While the composite mailing card may be suitable for some purposes, the patent does not describe a mailing piece with removable message labels suitable for accepting multi-color printing on one side of the mailing piece and removable message labels which may be also with multi-color printing on the opposing side of the mailing piece. Moreover, both of the aforementioned patents do not describe particular paper stocks or adhesives which may be used.

SUMMARY OF THE INVENTION

The present invention provides a postcard-type, mailing piece, with removable message labels, which does not suffer from the drawbacks of the articles heretofore known.

It is an object of the invention to provide a new, improved postcard-type mailing piece, with removable message labels, which meets the standards for postal and other distribution, and which can withstand the handling during such distribution without loss of message labels and without loss of quality and appearance.

It is a further object of the invention to provide a postcard-type mailing piece having removable, adhesively bonded message labels which can be reapplied and readhered to a variety of surfaces, such as surfaces which may be made of paper, cloth, glass, metal, wood or plastic, following removal from the mailing piece.

Still another object of the invention is to provide a postcard-type mailing piece, with removable message labels, which is strong enough to go through the mail, which has message labels releasable enough to come off the mailing piece yet strong enough to adhere, to another surface for affixing and which may be releasable from the reapplied surface when desired.

With these and other objects in mind, the present invention is directed to a postcard-type mailing piece with removable message labels comprising a paper sheet of desired, predetermined dimensions having first and second opposing surfaces. The paper sheet consists essentially of 40 to 60 lb., chrome coat, glossy, paper stock, preferably 60 lb. glossy paper stock, with at least one removable message label adhesively bonded to one surface of the paper sheet. The message label consists essentially of 90 to 110 lb. paper stock, preferably 100 lb. paper stock. A releasable, pressure sensitive, rubber based, permanent high bond strength adhesive coating with a minimum application temperature of 45° F. is applied to one side of the message label for adhesively bonding said label to the paper sheet on one surface thereof. The paper sheet paper stock is capable of accepting and retaining marking by inks from ballpoint pens, felt tip pens, pencils, typewriter ribbons and multicolor printing without smudging and bleeding, on the opposite surface to which the message label is adhesively bonded. The adhesive which bonds the message label to said paper sheet is capable of readhering to paper, cloth, glass, metal, wood and plastic surfaces following removal from the paper sheet. The message label paper stock is capable of receiving multi-color printing without smudging and bleeding.

The invention also includes use of a suitable adhesive, preferably an adhesive comprising a silicone release coating, to releasably adhere the message labels to the paper piece.

In addition to the foregoing, the invention further contemplates the use of a pore-containing paper stock for the mailing piece to which is applied a coating to fill the pores and to resist seepage of color printing and ink thereinto so as to minimize loss of color tones when color printing ink is applied to the mailing piece.

The invention will be better understood and additional objects and advantages will become apparent from the following description taken in connection with the accompanying drawing.

DETAILED DESCRIPTION OF THE PREFERRED EMBODIMENTS

Figure 1:
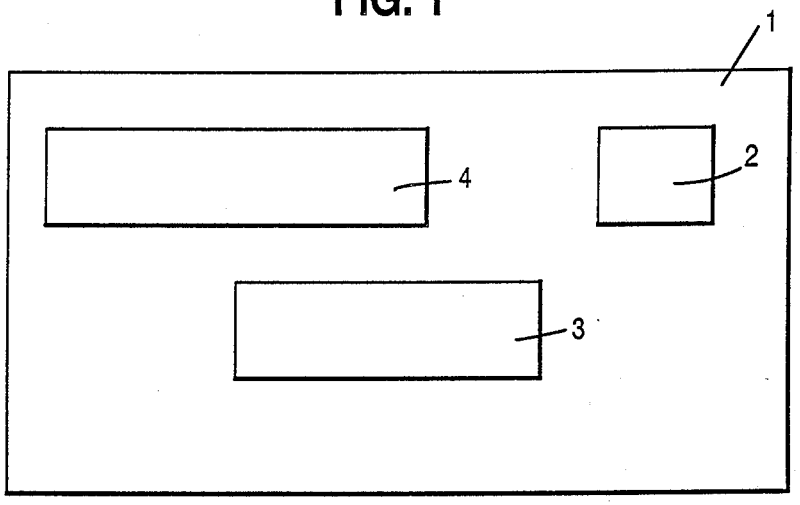
FIG. 1 is a front view of one surface of the postcard-type mailing piece in accordance with the invention.

Referring to FIG. 1 of the drawings, there is seen a first surface of a postcard-type mailing piece 1 on which space may be provided for a postal stamp and address 2 and 3, respectively, as well as advertisement, photographs or other message, 4, which may be applied as a multi-color printing on the surface thereof.

Figure 2:
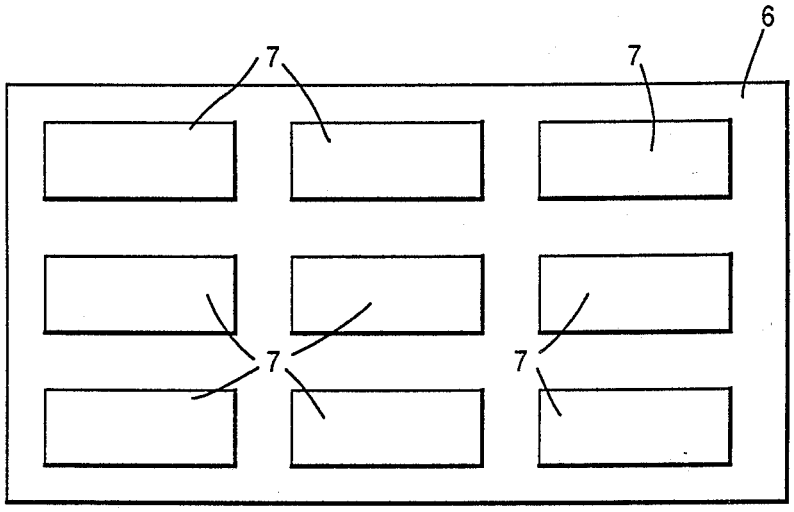
FIG. 2 is a front view of the opposing side of the postcard-type, mailing piece according to the invention.

In FIG. 2, which represents the opposing surface, 6, of the mailing piece shown in FIG. 1, there are shown various message labels, 7, which may be applied to the surface thereof by means of a removable, pressure sensitive adhesive, as will be hereinafter described.

To produce a satisfactory mailing piece a number of factors must be considered. A postcard size mailing piece must be constructed of paper stock which will hold its shape, accept printing ink and multi-color printing processes without bleeding through the paper stock and must accept the adhesive necessary to bond the message labels to the paper stock. The surface of the paper stock must also accept all types of inks from writing implements, such as ballpoint pens, felt-tip pens, pencils, typewriters, etc.

The adhesive used to bond the message labels to the paper stock must be strong enough to withstand handling during movement through the mail and distribution yet be releasable to enable removal of the message labels from the mailing piece. Although releasable, the message labels must also be able to be readhered to a variety of surfaces such as paper, cloth, glass, metal, wood and plastic. The paper stock for the message label should not be too heavy to add to the weight of the mailing piece yet cannot be too thin to permit bleeding of color printing which may be desirably applied to the message labels. The message label preferably has a glossy appearance but must also be capable of accepting ink from a variety of sources. However, the bonding side of the message label must be capable of accepting the necessary adhesive to coact with the surface of the mailing piece paper stock in a releasable manner.

It is obvious therefore that the postcard mailing piece in accordance with the invention comprises a critical combination of specially selected materials and represents a careful choice of particular paper stock for both the paper sheet and message label and of the adhesive for bonding the message labels to the paper stock of the mailing piece.

The paper stock which will form the message labels is applied as a laminate (liner) to the paper sheet by adhesively bonding the liner to the paper sheet, the adhesive being uniformly applied over substantially the entire surface to be bonded. Thereafter, the laminated composite is printed with the text forming the desired message and colored by a multicolor printing process. Following printing, the laminated composite is die cut to define the individual message labels, as desired, after which any waste material present is removed. The die cutting operation is carefully performed so that the message label liner is cut without cutting the paper sheet. The other surface of the paper sheet may be also subject to printing and/or multi-color printing process.

In the examples described in Table I, various pieces of white paper stock were individually cut to 4" x 6" size from rolls of papers. One surface was printed with two or more separate colors. A variety of adhesives for the message label paper stock were tried before settling upon the preferred silicone release coating adhesive used in the examples of Table I. The chosen adhesive is selected for having high initial tack and high bond strength to a wide variety of substrates including packing films. When applied to a paper stock surface it has excellent die cutting and automatic dispensing characteristics. The selected rubber based, permanent, pressure sensitive adhesive has a minimum application temperature of 45° F. It is strong enough to go through the mail yet sufficiently releasable to come off the paper stock mailing piece when received. It is sufficiently strong to readhere to another surface yet also sufficiently releasable to be removed from that applied surface if desired. Other adhesives having the required properties may be selected from available cold temperature adhesives, freezer-temperature adhesives, general purpose adhesives and repositionable adhesives.

As can be seen from the results in Table I, it is critically important to select the particular combination of paper stock for the paper sheet of the postcard and for the message label. Paper stock samples of 40, 60 and 100 lb. were used with various combinations of paper stock for the message labels. The results shown in Table I indicate that, of the examples shown, only a combination of 40–60 lb. paper stock for the mailing piece and 100 lb. paper stock for the message label together with the silicone release coating adhesive on the message label produced the results required in accordance with the invention.

TABLE I

| | Paper Sheet Paper Stock | Message Label Paper Stock | Comment |
|---|---|---|---|
| (1) | 40 lb | 50 lb | paper sheet not stiff enough, pen ink smudged |
| (2) | 40 lb | 60 lb | paper sheet not stiff enough, felt pen smudged |
| (3) | 40 lb | 90 lb | paper sheet would not remain flat; curled to original roll configuration |
| (4) | 40 lb | 78 lb | paper sheet not thick enough, clogged pens |
| (5) | 100 lb | 50 lb | not supportive enough when labels removed, labels too thick |
| (6) | 60 lb* | 100 lb | very good, paper sheet holds up during multi-color printing; passes |

TABLE I-continued

| Paper Sheet Paper Stock | Message Label Paper Stock | Comment |
|---|---|---|
| | | all tests |

*60 lb "Kromekote", glossy

In another example the message label liner of the mailing piece was printed over by a four color printing process to produce a color photograph depiction thereon. A varnish ultraviolet process was applied under and over the color photograph as a liquid cured by ultraviolet light to fill the pore holes in the message label paper stock. It was found that with this additional coating, seepage of color ink into the pore holes was avoided thereby minimizing loss of color tones in the photograph. Suitable varnishes for the foregoing purposes include commercially available white varnish (clear transparent) and printer's varnish. Varnish may be also applied to the face of the paper sheet opposite to the side having the message labels if useful to enhance multicolor and/or other printing thereon.

In some instances pore holes in the paper stock are desirable because they facilitate absorption of the ink from various writing implements such as ballpoint pens and felt tip pens and also permit quick drying of the inked surface.

Although various embodiments of the invention have been described, it is of course understood that modifications may be made which will be obvious to those of ordinary skill in the art. Such modifications are within the spirit and scope of the invention which is limited and defined only by the appended claims.

What is claimed is:

1. A postcard-type, mailing piece with removable message labels comprising:

a paper sheet of desired, predetermined dimensions having first and second opposing surfaces, said paper sheet being glossy paper stock of approximately 60 lb. weight;

at least one removable message label adhesively bonded to one surface of said paper sheet, said message label being paper stock of approximately 100 lb. weight;

a releasable, pressure sensitive, permanent high bond strength adhesive coating applied to one side of said message label for adhesively bonding said label to said paper sheet on one surface thereof;

said paper sheet paper stock being capable of accepting and retaining marking by inks and multi-color printing, without smudging or bleeding on the opposite surface to which said message label is adhesively bonded;

said adhesive which bonds said message label to said paper sheet being capable of readhering following removal from said paper sheet;

said message label paper stock being capable of receiving multi-color printing without smudging or bleeding.

2. A past card-type, mailing piece according to claim 1 wherein said adhesive comprises a rubber-based adhesive with a minimum application temperature of not less than 45° F.

3. A postcard-type, mailing piece according to claim 1 wherein said adhesive on said message label comprising a silicone release coating.

4. A postcard-type, mailing piece according to claim 1 further comprising a paper sheet consisting essentially of paper stock with pores, a pore filling coating on at least the surface of said paper sheet opposite to the surface to which said message label is adhesively bonded to resist seepage of color printing ink into said pores in said paper stock to minimize loss of color tones when color printing ink is applied thereto.

* * * * *